US006065412A

United States Patent [19]

Schwarzberger et al.

[11] Patent Number: 6,065,412

[45] **Date of Patent: *May 23, 2000**

[54] VERTICAL STITCHING MACHINE AND METHOD

[76] Inventors: Michael V. Schwarzberger, 7401 N. Albany, Chicago, Ill. 60645; Neal A. Schwarzberger, 205 Alpine Dr.; Joseph C. Podolski, 205 Apline Dr., both of Vernon Hills, Ill. 60061

[ * ] Notice: This patent is subject to a terminal disclaimer.

[21] Appl. No.: 09/119,262

[22] Filed: Jul. 20, 1998

Related U.S. Application Data

[63] Continuation-in-part of application No. 08/805,455, Feb. 25, 1997, Pat. No. 5,782,193.

[51] Int. Cl.[7] ..... D05B 21/00

[52] U.S. Cl. ..... 112/470.13; 112/117; 112/475.08

[58] Field of Search ..... 112/470.13, 470.12, 112/117, 118, 119, 475.01, 475.08, 475.17, 83, 470.31

[56] References Cited

U.S. PATENT DOCUMENTS 4,915,040 4/1990 Sakuma et al. ..... 112/2

5,782,193 7/1998 Schwarzberger et al. ..... 112/470.13

*Primary Examiner*—Peter Nerbun

*Attorney, Agent, or Firm*—Charles F. Lind

[57] ABSTRACT

The disclosed stitching machine has perimeter clamps to grip the edges of flexible sheet(s): the leading edge clamps being carried on a conveyor to pull the sheet(s) to the stitching area, and the side edge clamps at the stitching area being positioned initially within the area of the sheet(s) and then separated until reaching the respective side sheet(s) edge and being closed, and then being shifted to square the side edges relative to the leading edge. Separation of the opposed clamps stretches the sheet(s) to a flat stitchable condition. The sewing machine can be moved from its home start position until positioned accurately proximate the trailing and side edges of the flat sheet(s), for centering or otherwise locating the stitching pattern relative to the sheet (s).

10 Claims, 6 Drawing Sheets

VERTICAL STITCHING MACHINE AND METHOD

RELATED APPLICATIONS

This is a continuation-in-part application of our application filed Feb. 25, 1997 and having Ser. No. 08/805,455 for the invention entitled VERTICAL STITCHING MACHINE AND METHOD, and issued Jul 21, 1998 as U.S. Pat. No. 5,782,193.

BACKGROUND OF THE INVENTION

The common bed quilt typically will have a mat or equivalent fill of lightweight open-cell or porous material sandwiched between more durable and/or attractive cloth or fabric sheets. Such quilts can be commercially made by initially seaming the layered components together at the perimeters, and then by sewing or stitching them together along patterned seams spaced inwardly from the perimeters. Other products having layered cloth or fabric sheets without any sandwiched fill, or even a single sheet can also have related interior patterned seams or stitchings for holding the sheets together and/or for merely decorative purposes.

Most commercial machines for quilting or stitching fabric sheets utilize a perimeter frame or rack to which the flexible sheet(s) when stretched flat could be clamped. The sheet frame, while aligned horizontally, would then be manipulated to position its clamped sheet(s) between the opposed upper or needle head and lower hook or base components of a sewing machine, which would stitch through the sheet(s) to complete the patterned interior seams. To accommodate this, perpendicularly arranged "X" axis and "Y" axis guide tracks are provided for the sheet frame and/or sewing machine, suited thereby upon specific combinations of relative "X" axis and "Y" axis movements between the sheet frame and sewing machine for generating the desired patterned seams.

One such type of stitching machine has the vertically separated and opposed needle head and base components of the sewing machine horizontally stationary, and the sheet frame and clamped sheet(s) only are moved horizontally along "X" and "Y" axes relative to and between the opposed operating sewing machine components to trace out the patterned seams on the clamped sheet(s). However, to provide complete patterned seam coverage over most of the sheet interior, the guide track and/or frame structure and/or clearance space for actual sheet frame movements need be extended horizontally to approximately four times the size of the sheet frame. An improved type of stitching machine further provides that the opposed sewing machine head and base components are moved in unison alone the "X" axis or side to side of the sheet frame, reducing the size requirements of the stitching machine frame by almost one-half while yet being approximately twice the size of the sheet frame. Another improved type of stitching machine further moves the sewing machine alone the "Y" axis or lengthwise of the sheet frame, reducing the size requirements of the stitching machine again by almost one-half but yet being more than the sheet frame itself.

Thus, as the clamped sheet(s) are stretched out to full size and are oriented horizontally when being stitched in most if not all existing interior seam stitching machines, such stitching machines require floor space larger than the flexible sheet goods or quilt itself, and frequently several times larger than this minimum size. Moreover, additional floor space at least as large as the sheet frame is typically needed for supporting the sheet frame when it is outside of the stitching machine, as when the flexible sheet(s) is clamped to or removed from the sheet frame.

Of further concern, clamping or racking of the sheet(s) prior to being stitched (and frequently releasing even after being stitched) can add significantly to both the time and effort, and thus the cost overall, for such stitching. This can include the added effort needed to adjust the clamping/racking mechanisms to accommodate sheet(s) of different sizes or shapes, needed to stitch bedding quilts for example of different sizes.

SUMMARY OF THE INVENTION

This invention relates to a machine for and method of stitching interior patterned seams on flexible fabric sheet goods, specifically including on quilts.

A basis object of this invention is to provide an improved stitching machine and its method of stitching that greatly reduces the needed floor space requirements therefor, compared to prior art stitching machines.

A specific feature of the invention is an improved method of stitching flexible sheet(s) along interior patterns or seams spaced from the perimeter of the sheet(s), which comprises having the sheet(s) oriented substantially vertically during such stitching. The working tool or stitching machine is guided along the "X" or horizontal axis and "Y" or vertical axis, in a controlled manner dictated by conventional drives and controls. The vertical orientation of the work piece or sheet(s) allows for a stitching machine to practice the method with frame width requirements comparable to the width of the sheet(s) being stitched, but less than and virtually independent of the length of the sheet(s) being stitched, reducing the otherwise horizontal floor space requirements of such stitching machine.

Another specific feature of the invention is to provide a horizontally compact stitching machine and conveyor therefor, suited to move the sheet(s) to be stitched through the machine and past the sewing machine components to then be operated automatically by conventional controls, yielding a stitching machine and method that can be practiced by less than a full-time operator, meaning that one operator will be able to handle the work demands of several like simultaneously operated stitching machines clustered around the operator.

Another object of this invention is to provide mechanism for clamping the sheet(s) prior to being stitched, and releasing the sheet(s) after being stitched, including for automatically adjusting the clamping/racking mechanisms to accommodate sheet(s) of different sizes or shapes, conventionally needed to stitch bedding quilts of many different sizes.

Other specific objects of the invention provide mechanism and method for detecting the specific locations of the suspended trailing side edges of a leading edge gripped and advanced sheet(s) suited for gripping the sheet(s) more consistently at the edges, and then for squaring up the side edges relative to the gripped leading edge; and further for specifically detecting the locations of several of such edges of the sheet(s) relative to a staring location of a sewing machine for example, suited for allowing the computer instructions for moving the sewing machine for stitching the desired pattern(s), for example, to be made responsive to these edge locations for centering or otherwise more accurately locating the stitched pattern(s) relative to such held sheet(s). These features allow improved stitching due to the likelihood of the sheet(s) being held flat and wrinkle free and of having the stitching pattern(s) properly located thereon.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF PREFERRED EMBODIMENTS OF THE INVENTION

Figure 1:
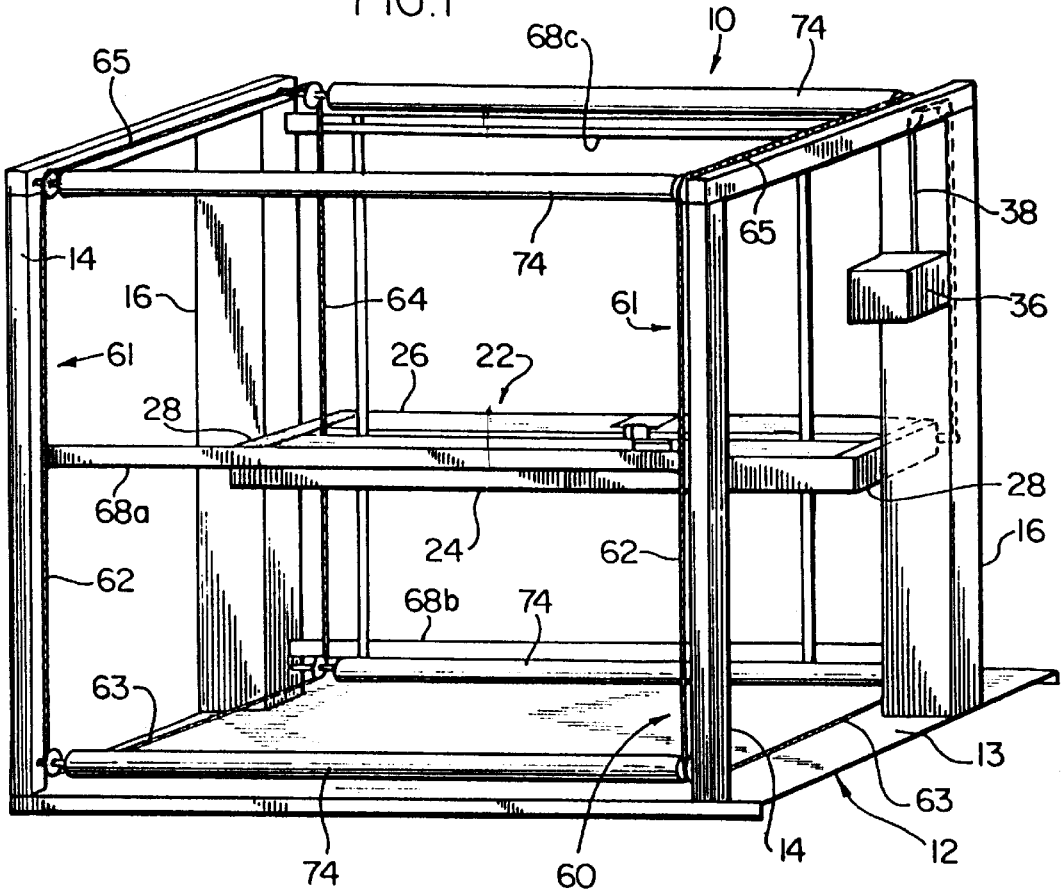
FIG. 1 is a perspective view of a stitching machine suited for operation according to the inventive method, where no external panels are illustrated for clarity of disclosure of the underlying operative components.
Figure 2:
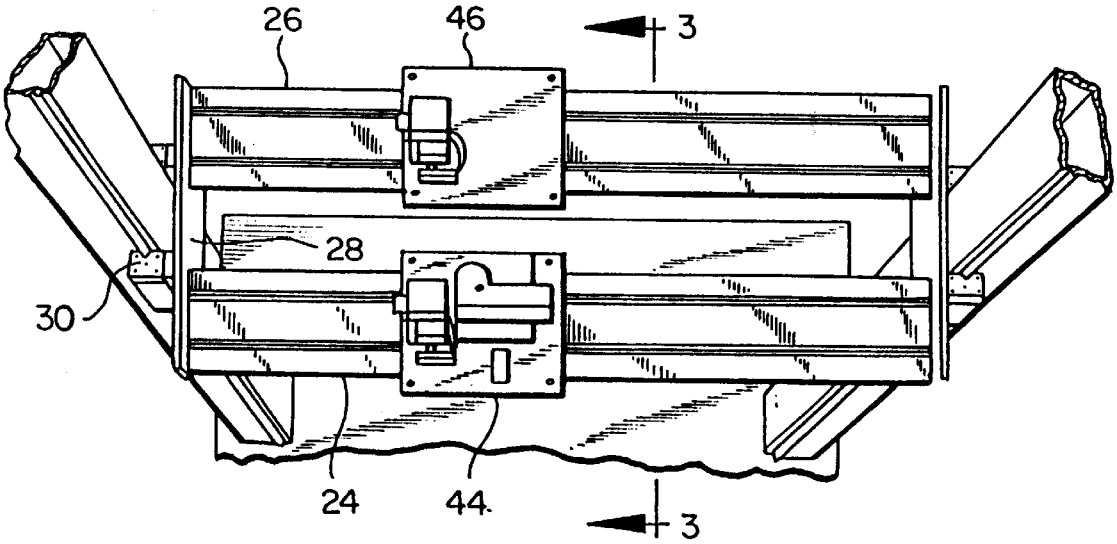
FIG. 2 is a perspective view of bridge structure of the stitching machine of FIG. 1, from a steeper viewing angle.

One specific stitching machine 10 to be disclosed now serves as a basic embodiment of the inventive apparatus and method. For clarity and ease of disclosure, not all components or specific details of a component are illustrated in all figures where such might appear and be adequately illustrated in another figure; and conventional components may not be illustrated in precise details.

The stitching machine 10 has a frame 12 comprised of base 13 and front vertical side columns 14 and rear vertical side columns 16 upstanding from the base. A cross bridge 22 comprised of horizontally separated front and rear beams 24, 26 extended between end members 28 terminates proximate the rear vertical columns 16, and guide means 30 cooperate between the bridge end members 28 and rear vertical columns 16 to restrain the bridge 22 to move vertically along the rear side columns 16 with the bridge beams 24, 26 aligned generally horizontally. Drives 32 move the bridge end members 28 in precise unison vertically along the side columns 16, maintaining the bridge in horizontal alignment.

Counterweights 36 are guided vertically along the rear vertical columns 16 by conventional means (not shown), and cables 38 trained over pulleys near the top of the side columns 16 connect the counterweight and cross bridge together, to off-set the gravity bias of the bridge 22 during its vertical movement.

Mounting platforms 44, 46 are carried on the front and rear bridge beams 24, 26 respectively, and guide means 40 cooperate between the platforms and bridge beams to allow the platforms to be moved along the beam lengths generally between the bridge end members 28. Drives 42 are provided to move the platforms 44, 46 simultaneously in precise unison along the beams, maintaining them directly opposed to one another and horizontally aligned.

A separate drive 42 will be provided for each beam-platform, and in the embodiment illustrated includes a rack 43*a* secured to the beam and engaged by a pinion 43*b* driven by a gear motor 43*c* carried on the platform 44 or 46. The drives 32 for the bridge 22 can be similar, with separate racks secured to the different vertical rear side columns 16 and the pinions and gear motors being carried off of the opposite bridge end members 28.

Mounting platform 48 is carried on the front beam platform 44, and guide means 50 cooperate between the platforms 44, 48 to move the platform 48 only in the direction normal to the beam length and/or the movement of the platform 44 along the beam 24. A linear drive 52 such as an air cylinder connected between the platforms 44, 48 powers the platform 48 toward and away from the rear platform 46 when needed.

Figure 3:
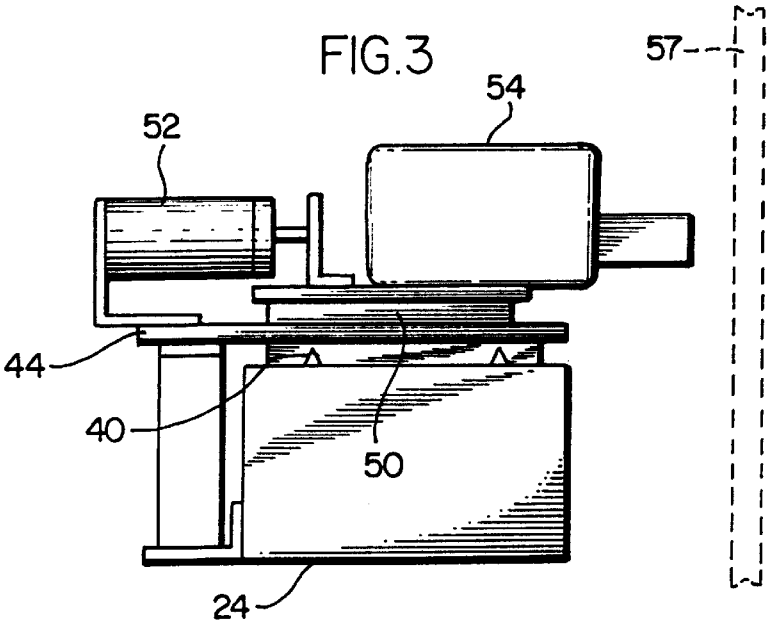
FIG. 3 is an enlarged sectional view as seen from lines 3—3 in FIG. 2.
Figure 5:
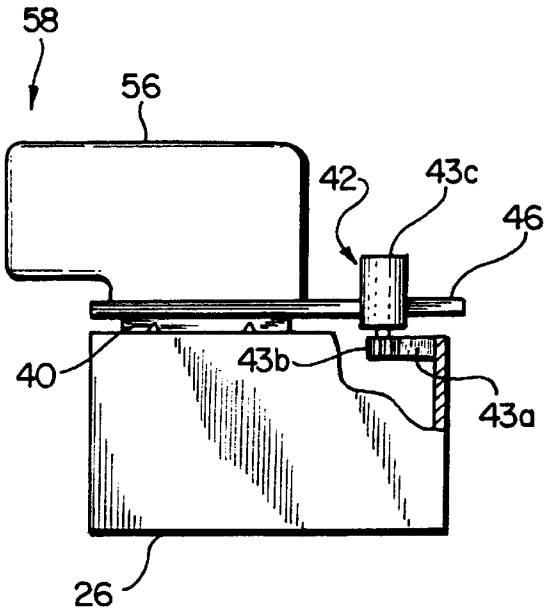
FIG. 5 is a side view of a conveyor cross bar and a typical sheet grip carried thereon.
Figure 5:
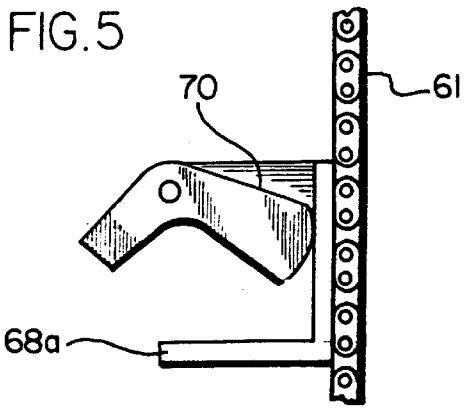
Figure 4:
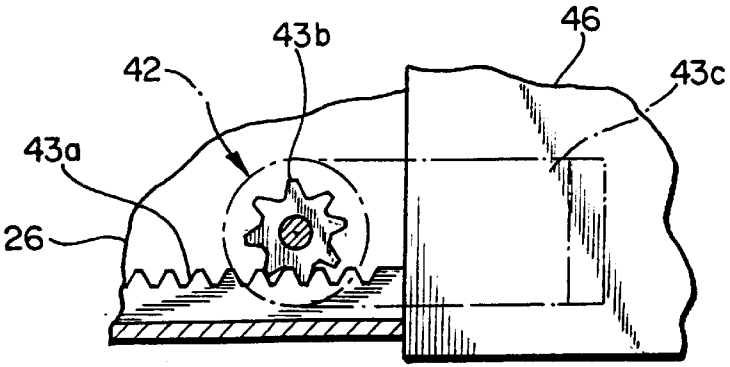
FIG. 4 is a top view of a platform drive used on the bridge structure of FIG. 3.

Cooperating components 54, 56 of a conventional sewing machine 58 are carried respectively on the front and rear beam mounting platforms 44 (via platform 48) and 46; the component 54 generally being the needle or head component and component 56 being the hook or base component of the sewing machine. The sewing machine needle and hook components 54, 56 are thus spaced apart horizontally as illustrated in FIG. 3 suited to allow the passage therebetween of flexible sheet(s) to be stitched (shown only in phantom as 57), and drive 52 allows movement of the needle component 54 horizontally toward and away from the hook component 56, suited when brought together to be in operative opposed and proximate cooperation for stitching through the sheet(s) 57 to form the intended interior patterned seams.

An endless loop conveyor system 60 is provided on the frame 12, having separated drive belts 61 extended as front and rear vertical runs 62, 64, and lower and upper horizontal runs 63, 65, with the plane defined by the rear vertical run 64 specifically passing between the opposed needle and hook sewing machine components 54, 56. Horizontal cross bar 68*a*, 68*b* and 68*c* are connected between the drive belts 61, each having clamps 70 thereon suited to grip and hold a stretched leading end of the flexible fabric sheet(s) to be stitched in the machine 10; before, during and even after such stitching. Horizontal rolls 74 are also mounted near the front and rear, and upper and lower corners between the directional conveyor runs 62, 63, 64, 65, to guide and/or support the carried sheet(s) around the loop corners. The rolls 74 can be powered to rotate at a peripheral speed corresponding to the travel speed of the conveyor system.

Horizontally extended supports (not shown) can also be positioned under both the lower and upper horizontal loop runs 63, 65 for supporting the flexible sheet(s) passing such locations.

The effective vertical height of the rear conveyor run 64 exceeds the length of the fabric sheet(s) to be stitched, whereby the trailing portions of the fabric sheet(s) can suspend or hang vertically below the clamping cross bar 68*c* when near the top of the rear vertical conveyor run 64, including passing between the opposed needle and hook sewing machine components 54, 56. The width of the conveyor system, including the length of the clamp bars 68*a*, 68*b*, 68*c* exceeds the width of the flexible sheet(s) to be stitched.

Figure 6:
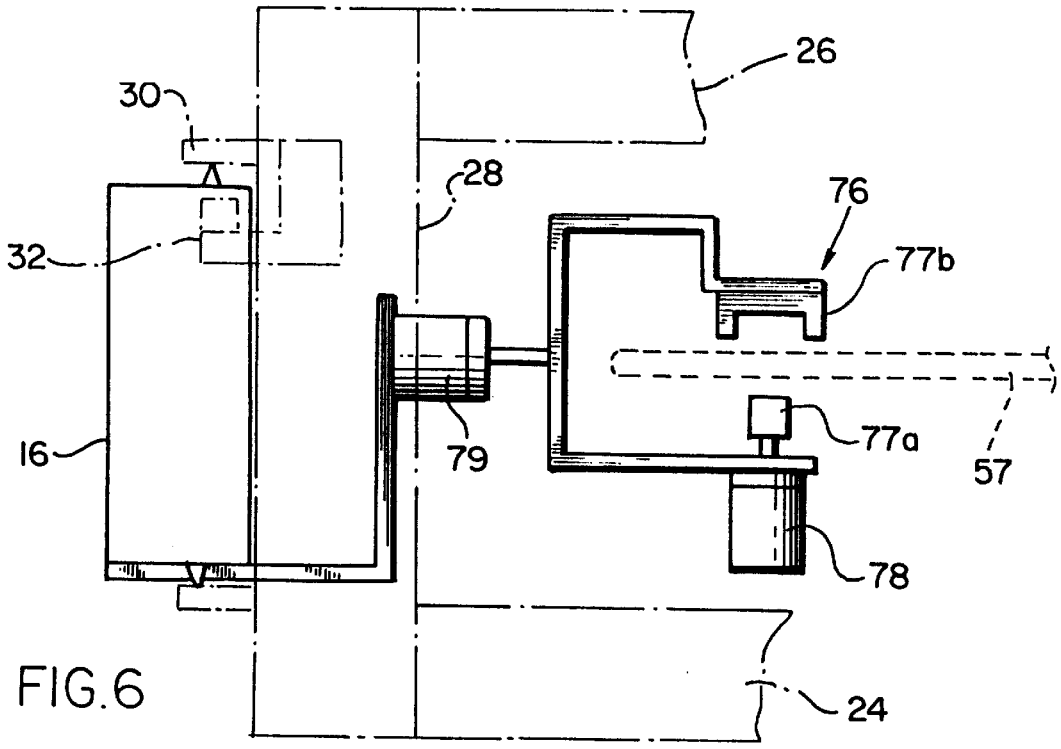
FIG. 6 is a top view of the bridge-side column mounting and drive, and of side clamp structure utilized in the stitching machine of FIG. 1.
Figure 7:
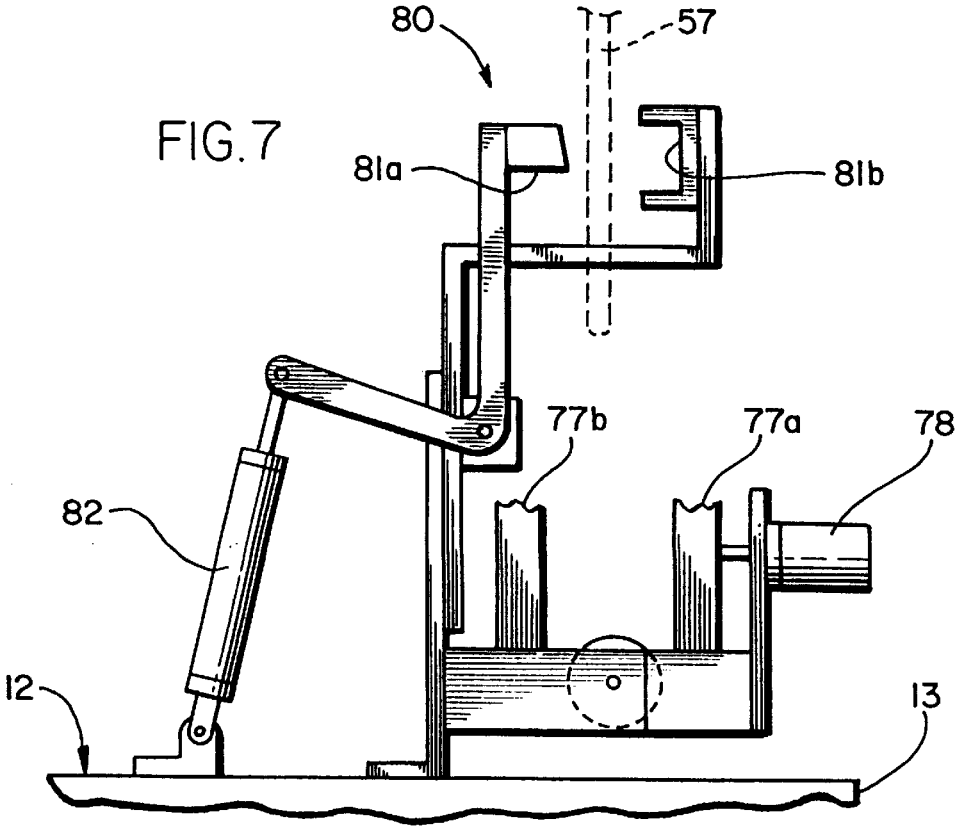
FIG. 7 is a side elevational view of part of the side clamp structure of FIG. 6, and of a bottom clamp structure utilized in the stitching machine of FIG. 1.
Figure 10:
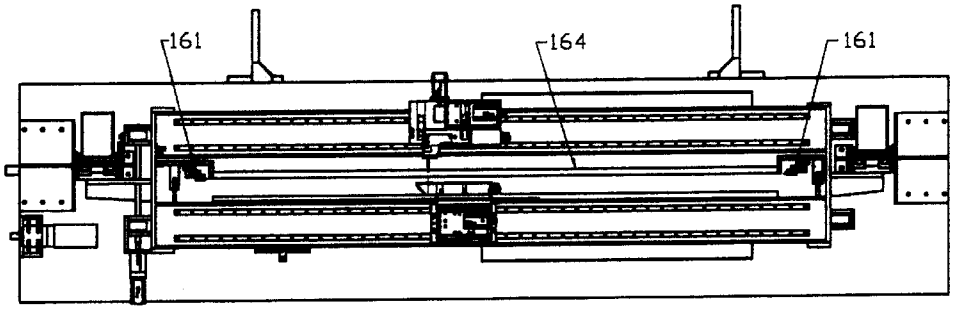
FIG. 10 is a top plan view of the stitching machine of FIGS. 8 and 9.
Figure 9:
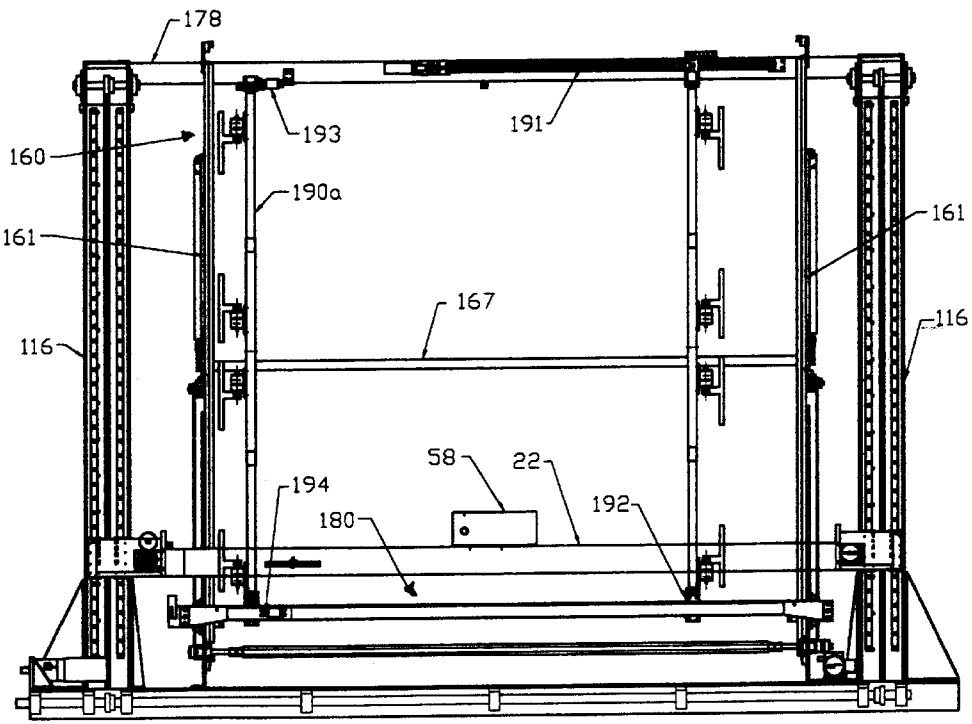
FIG. 9 is a front elevational view of the mechanism of FIG. 8, with only certain of the working components of the stitching machine being illustrated.
Figure 8:
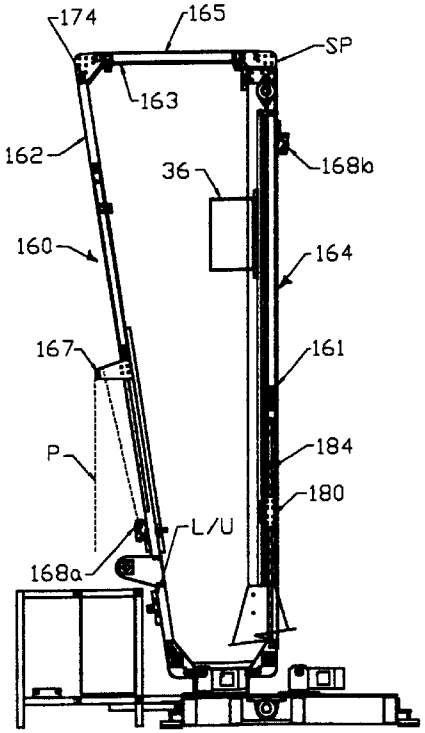
FIG. 8 is a side elevational view of an alternate embodiment of loop conveyor mechanism for use in a stitching machine formed according to the invention disclosed in the previous figures.

Side clamps 76 (FIGS. 6 and 7) are provided on the frame 12 to extend along the opposite sides of the rear vertical conveyor run 64, each clamp being comprised as elongated bars 77*a*, 77*b* horizontally separated and aligned to overlap opposite front and rear sides of the sheet(s) (in phantom as 57) as suspended from the cross bar 68*c*, extended also between the top leading and bottom trailing edges of the sheet(s). Linear drive or air cylinder 78 can be actuated to shift clamp bar 77*a* toward clamp bar 77*b*, to grip the vertical side edges of the sheet(s). Linear drive or air cylinder 79 can then be actuated to slightly separate the opposite side clamps horizontally in the plane of the suspended sheet(s) to stretch them tightly side-to-side. Bottom clamp 80 comprised of horizontally opposed bars 81*a*, 81*b* can further be provided on the frame 12 along the bottom trailing edge of the suspended sheet(s), with air cylinder 82 powering bar 81*a* transverse to the suspended sheet(s) to grip the bottom thereof. Once gripped, the conveyor system 60 can be inched vertically upward to stretch the sheet(s) tightly top-to-bottom or leading edge-to-trailing edge.

A preferred endless conveyor system overall loop length will slightly exceed three times the length of the flexible sheet(s) to be stitched, whereby three cross bars 68*a*, 68*b*, 68*c* can be provided equally spaced apart on the conveyor loop, each being advanced one-third of the way around the loop during the index cycle of the conveyor system. Further, the loop size can be proportioned so that the positions of the three cross bars after each conveyor index will be positioned respectively as 68*a* at the front load position in the front vertical loop run 62, as 68*b* at a ready but pre-stitching position near the bend or juncture between the lower horizontal loop run 63 and the rear vertical run 64, and as 68*c* at the operative stitching position near the upper end of the rear vertical run 64.

The stretched leading end of the flexible sheet(s) to be stitched can be secured, manually or otherwise, to the conveyor cross bar at the 68*a* position stopped at a comfortable height spaced above the floor. One conveyor system index advances the cross bar to position 68*b*, carrying the leading end of the flexible sheet(s) with it, initially by moving the bar downwardly from the initial clamping position to the bottom of the front vertical run 62, and then rearwardly along the lower horizontal run 63 toward the rear vertical run 64. The next conveyor index upwardly advances the cross bar to the 68*c* position near the top of the rear vertical run 64. The stitched sheet(s) will be carried with the next conveyor index back to the 68*a* position.

With the disclosed stitching machine 10, one operator can easily remove a stitched sheet product from the clamp bar at position 68*a*, and then clamp another pre-stitched sheet(s) onto the same cross bar; while the immediately preceding cross bar 68*b* is in the ready position near the lower end of the loop run 54, while the next preceding cross bar 68*c* is at the top of the rear vertical run and its clamped sheet(s) might be stitched. As the typical stitching cycle for making the patterned seams on the sheet(s) can take between approximately one and even ten minutes, one operator likely will be able to simultaneously take care of several clustered stitching machines, moving from one machine to another, for greatly reduced labor costs for preforming such seam stitching. This can be contrasted against most conventional stitching machines that utilize a sheet frame and typically require one operator for each machine.

One important aspect of the disclosed stitching machine 10 and the incorporated method is that the pre-stitched flexible sheet(s) can be loaded directly onto the conveyor system 60 and then be carried thereby to suspend or dangle freely along a substantially vertical plane, whereupon the sheet(s) can be racked or stretched out along both the "X" and "Y" axes and secured along its peripheral edges in a pre-stitching condition; so that stitching of the sheet(s) can take place. This vertical orientation of the sheet(s) during stitching allows the front-to-rear horizontal space requirements or depth of the stitching machine to be significantly reduced, compared to commercially available stitching machines that stitch the sheet(s) supported in a horizontal plane by a sheet frame. Specifically, the overall front-to-rear horizontal space requirements or depth of the stitching machine itself can be reduced to possibly one-sixth or one-third the corresponding size of the smallest commercially used existing stitching machine.

Moreover, the distinctive stitching machine and method operates without a supplemental sheet frame for holding the sheet(s) during and after the stitching, and the needed floor space outside of the conventional stitching machine for racking the pre-stitched sheet(s) and removing the stitched sheet goods.

Additional specifics of the drives 32, 42 mentioned herein will now be discussed. Drives 32 must move the opposite ends of the bridge 22 vertically in precise unison, to keep the bridge 22 in horizontal alignment. Drives 42 must move the beam platforms 44, 46 in precise unison along the length of the bridge beams 24, 26, to provide that the sewing machine components 52, 54 remain in proper cooperation, exactly horizontally aligned and opposed to one another. To provide for this, the drives 32, 42 can include positive and accurate positional linkages having minimal free play, such as the illustrated precision rack and pinion drives, or with high tolerance ball screw mechanisms. Further, drives are to be controlled as part of servo mechanisms that use the position, direction of movement, or orientation of the components as process variables and detect any variance from set points or target values, and via feedback of the detected differences readjust the input to the drives. Servo mechanisms and controls of this type specifically are provided by Yaskawa Electric America, Inc. having offices at 2942 MacArthur, Northbrook, Ill. 60062, particularly suited for use in the disclosed stitching machine.

Further, the cooperating opposed needle head and base components of the sewing machine are maintained and operated in precise unison, both as to the speeds and positions of the components, by the use of such servo mechanisms and feedback controls, specifically including the use of master-slave interlock of the separate motors powering the separate respective components. This allows the controlled operation of the separate component motors while being separated on opposite sides of the sheet(s) during stitching, and without mechanical drive linkages between the motors.

Conventional photocell components (not shown) can be positioned adjacent the vertical rear run 64 of the conveyor system near the upper end thereof, suited to detect the leading edge of the gripped sheet(s) suspended from the clamp bar and to stop the conveyor advance or indexing as such approaches the proper stitching position. Once stopped, the bottom gripper mechanism 80 can be actuated to hold the trailing edge of the suspended sheet(s). Inched advancing movement of the conveyor can stretch the suspended sheet (s) vertically or along the "Y" axis. Actuation of the clamps 76 can grip the side edges of the suspended sheet(s), and of the drive 79 can stretch the sheet(s) horizontally or along the "X" axis. All of these racking steps can be carried out automatically by means of sensors and/or computer controls now used in the stitching machine art. Also, once the sheet(s) are suitable racked in the vertical orientation along the conveyor run 64, the sewing machine can be shifted automatically along the "X" and "Y" axes as needed via actuation of the respective drives 42 and 32 to trace out the intended seam pattern, again by using conventional computer controls now used in the stitching machine art.

Different mechanism for handling or racking the sheet(s) to be stitched will now be disclosed, being particularly effective for squaring up, gripping and stretching the sheet(s) before stitching, regardless of the size thereof. For example, sheet products in the form of bedding quilts can be conveniently held and stitched in the disclosed machine, and such quilts can come in many different popular sizes: such as possibly 70" by 80" for use on a twin size bed and possibly 110" by 110" for use on a king size bed.

Figure 14:
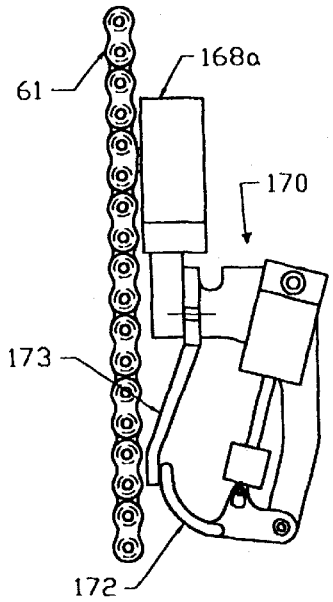
FIG. 14 is a side elevational view of an individual clamp suited for gripping the leading edge of the sheet(s)

The conveyor loop 160 might have a rear run 164 wider and higher than the largest expected length and width dimensions of the sheet(s) 157 to be held and stitched, with the chain drives 161 being outwardly adjacent the suspended sheet(s). Top or leading edge clamping beams 168*a*, 168*b* can be connected at their ends to the conveyor loop drives 161 at equal separations and carried successively, repeatably and concurrently between the loading/unloading position (at L/U) and the stitching position (at SP). Individual clamps 170 secured at spaced locations along each leading edge beam 168*a*, 168*b* are provided to grip the sheet(s) near the top leading edge thereof. The clamps 170 (see FIG. 14) can be conventional, having a stationary face 171 and a moveable finger 172 spring biased to the illustrated closed clamping positions and being shifted to the opened positions (not shown) by air under pressure being applied to cylinder 173. Each leading edge beam can have an interior passageway (not shown) communicating with each clamp cylinder and can have an inlet opening at one beam end to the passageway; and a conventional doffer port assembly 175 can be mounted adjacent but spaced from the leading edge beam when at the loading/unloading position L/U. The doffer assembly 175 might include a movable hollow porting rod that when under pressure is shifted against the adjacent beam, operable to seat with the beam passageway inlet to pressurize the passageway and open the clamps 170.

Trailing edge or bottom clamp means 180 might be comprised of a cross beam 181 extended laterally beyond the conveyor loop drives 161 to rear vertical posts (guiding and partly enclosing chain drives 161), and linear bearings between the cross beam and each post hold the beam parallel to the conveyor cross beams 168*a*, 168*b* and allow the beam 181 to slide vertically along the post and thus substantially parallel to and along the rear conveyor run 164. Linear drives 184 power the beam 181 vertically along the posts, being comprised of a pair of endless drive loops each elongated along one of the posts and riding over end sprockets mounted to rotate relative to the posts, with a reversible motor (not shown) driving a sprocket of each loops, and with the cross beam 181 being linked at each end to one side only of each loop. A clamp bar 187 connected at its ends to the cross beams 181 by linear bearings is moveable transverse to the plane of the suspended sheet(s) 157 and the rear run 164; and power cylinders 188 can be activated to shift the bar between a clamping position against the beam (not shown) and a release position spaced therefrom so that the leading edge clamping beams 168*a*, 168*b* and gripped sheet(s) 157 can be freely passed therebetween. The bottom clamp beam 181 travel along the chain drive support posts should be sufficient for gripping the trailing edge of any sheet(s), when suspended from the stitching position SP, that is sized between the expected maximum and minimum "Y" dimension of the sheet(s).

The side grippers 176 might be comprised of elongated substantially rigid side gripper bars 190*a*, 190*b* located inwardly of the conveyor loop drives 161, each bar being mounted near its ends via linear bearings to upper cross beam 178 extended between the main rear vertical side columns 116 and to the trailing edge clamp beam 181, effective to be moved horizontally in the "X" dimension toward and away from one another. One gripper bar 190*a* is powered by upper and lower linear drives 191, 192 mounted on the respective cross beams 178, 181 (the linear drives being ball screws or the like having a long effective stroke and each drive having a motor and control suited to be operated independently of the other, or together in unison. The other gripper bar 190*b* is powered by upper and lower linear drives 193, 194 mounted on the respective cross beams (the linear drives being power cylinders or the like having a shorter operative stroke and again each drive having a control suited to allow operation independently of or in unison with one another. The linear ball screw drives 191, 192 provide side bar adjustment for clamping sheet(s) between the largest and smallest expected horizontal or "X" dimension, while they and the linear power cylinder drives 193, 194 can be operated for stretching the sheet(s) in the "X" dimension.

Figures 11, 12, 13:
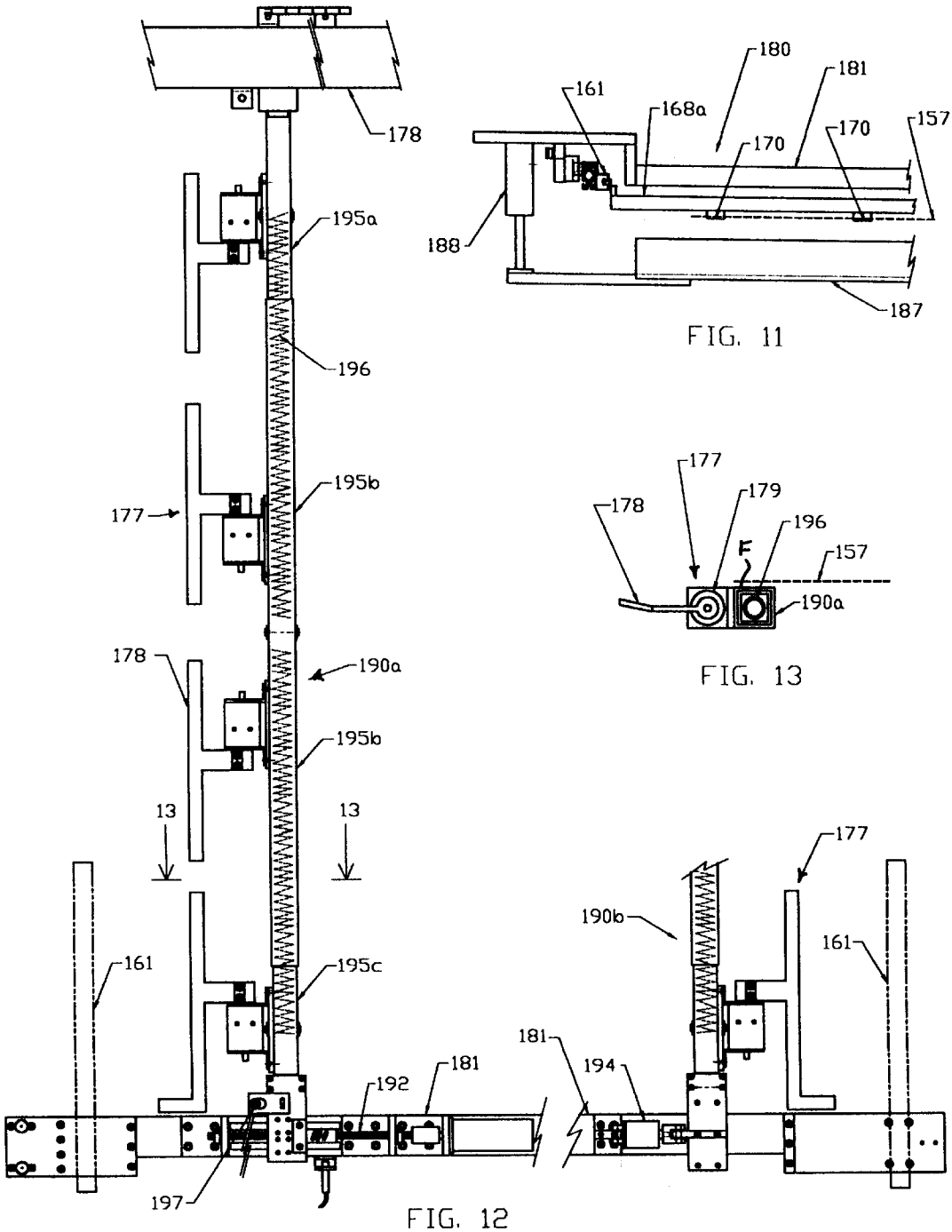
FIG. 11 is a top plan view of the trailing edge clamping mechanism.
FIG. 12 is an enlarged front elevational view of the right and left side clamping mechanism for gripping side edges of the flexible sheet(s)
FIG. 13 is a sectional view of an individual clamp as taken generally from line 13—13 in FIG. 12.

The elongated side bars 190*a*, 190*b* are axially extendable in length, being formed of telescoping end and intermediate sections 195*a*, 195*b*, 195*c* to provide bar length adjustment for clamping sheet(s) between the maximum and minimum expected vertical or "Y" dimensions. Tension springs 196 connected between the telescoping bar sections bias them to the shortened side bar lengths (generally illustrated in FIG. 12). Separate rotary powered grippers 177 are supported vertically spaced apart at adjustable positions along the side bars 190*a*, 190*b* (such as one or more being on each telescoping bar section 195*a*, 195*b*, 195*c*), each gripper having a grip bar 178 suited to be rotated by motor 179 between a clamping position against an adjacent side bar clamping face "F" and a release position approximately a half turn therefrom and spaced from the side bar face. The side bars clamping faces line up generally parallel to and closely adjacent or along suspended sheet(s) 157 and the rear conveyor run 164.

Although substantially rigid along their lengths, the telescoping side bars and the end connections allow sufficient lateral play for angling the side bars 190*a*, 190*b* slightly relative to one another to converge downwardly and be closer together at the trailing edge clamping beam 181 than at the cross beam 178, or vice versa. The linear power drives 192, 194 mounted on the trailing edge beam can be operated independently to provide this side bar convergence (or divergence), which corresponds somewhat to natural side edge furling that flexible sheet(s) might have when suspended freely along a horizontally supported upper edge.

Figure 15:
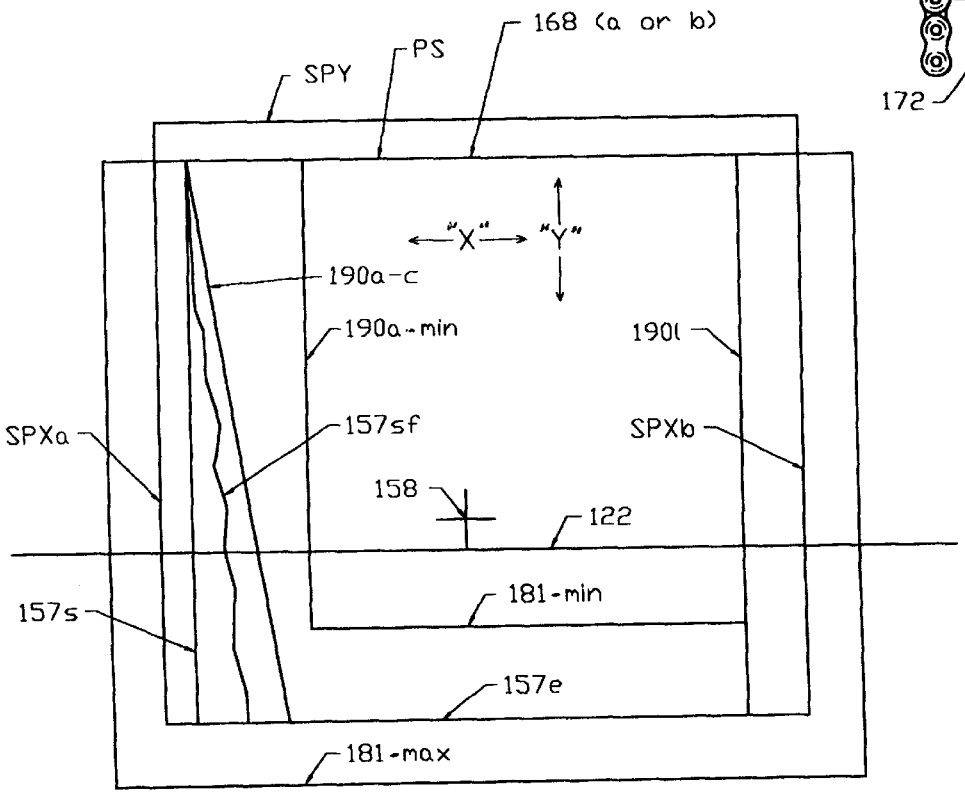
FIG. 15 is a front elevational view illustrating in schematic the leading, side and trailing edges clamping mechanisms shown in the minimum and maximum size positions of size adjustment, and also showing a possible starting position of flexible sheet(s) prior to clamping, at squared up positions, and at the stretched stitching positions; and showing also home or start position of the sewing machine relative to the sheet(s) as clamped, regardless of the size of the sheet(s)

The clamping and stretching mechanism can be operated by manually securing the leading edge of the sheet(s) within the clamps 170, when such leading edge beam 168*a* or 168*b* is at the loading/unloading position L/U; whereupon the conveyor loop 160 operation ultimately advances this beam upwardly along the rear run 164 to a prestretch position PS (FIG. 15) slightly below the stitching position SPY). The unsecured trailing portions of the sheet(s) are drawn then to lie along the rear conveyor run, suspended below the clamping beam, whereupon the trailing edge clamps 180 can be activated to grip the sheet(s) near the trailing bottom edge 157*e* thereof. With both the leading and trailing edges gripped, the loop conveyor 160 can be operated again, to vertically inch the leading edge beam from the prestretch position PS to the stitching position SPY, suited to stretch the sheet(s) in the "Y" direction. Further, the side bars 190*a*, 190*b* can be slowly shifted apart at their lower ends by activation of the lower linear drives (linear ball screw drives 192 and power cylinder 194) independently of one another from a convergent orientation (as at 190*a–c*. A sensor 197 (such as a photocell carried on the lower end of each side bar) can detect the respective side edge 157*sf* of the sheet(s) to determine when the side bar becomes properly located for clamping the freely suspended side edge, whereupon the clamps on that side bar can be activated to grip and hold the edge relative to the side bar 190*a* or 190*b*. The linear drive actuation will yet continue to rotate the side bar into the perpendicular or squared up orientation 157*s* relative to the leading and trailing clamping edge beams 168*a* or 168*b* and 180. If either side edge of the sheet(s) has not been sensed when the respective side bar reaches the squared up orientation 157*s*, a default control can provide that these side bar clamps will be actuated at this square up orientation. With the side bars 190*a*, 190*b* squared up, the individual activation of linear drives will be terminated; however, the linear drives 191, 192 and/or 193, 194 can now be simultaneously and equally activated to separate the side bars horizontally and stretch the sheet(s) in the "X" direction (to SPXa, SPXb). The maximum "Y" and "X" stretched positions can be set by fixed detectors (not shown) adjusted to have the sheet(s) drawn reasonably flat and tight suited for stitching.

While the detailed sequence effectively yields consistently squared up sheet(s) suited for accurate stitching, the vertical or "Y" and horizontal or "X" stretching can be done in the reverse order, or simultaneously. Further, the convergence and/or divergence of the side bar clamps can be of benefit in lining up with and gripping side edges of sheet(s) slightly but intentionally out of square, and pulling the sheet(s) tight to be suited for stitching even though out of square.

This invention further improves the ease of unloading the stitched sheet product (bedding quilt for example) from the machine. Thus, the loop conveyor front run 162 is inclined rearwardly from the corner roll 174 at the front of top run 165, to and past the unloading/loading position L/U located at a convenient height above the floor, suited for having an operator manually clamp the sheet(s) thereto as above noted. The corner curve 174 can actually be part of a cage 163 supported under and spanning the top run 165 to be on the inside of the conveyor loop 160, so that the finished product can be supported on and ride over the top side of the cage as it is pulled between the rear run 164 and the front run 162, and downwardly around the corner curve 174. Support bar 167 is secured to guide structures for the loop conveyor chain drives to span the front run 162, slightly forwardly of the front run and/or outwardly away from the conveyor loop and both horizontally and vertically between the corner curve 174 and the loading/unloading position L/U. The bar 167 might be fixed in place at a height above the loading/unloading position L/U approximately one-half the vertical or "Y" dimension of the sheet(s) being stitched on the machine. The gripped leading edge of the stitched sheet(s) will thus be moved downwardly past the support bar 167 and the trailing remainder of the stitched sheet(s) (or sheet product) will eventually fall from the top run 165 to become draped over the support bar 167. With the leading edge gripping beams equally spaced around the conveyor loop, one gripping beam will reach the prestretch position (PS, mentioned above) just below the stitching position SP concurrently with the other gripping beam being closely adjacent but slightly spaced vertically above the loading/unloading position L/U, while the trailing remainder of the sheet product will yet be draped over the support bar 167. As the conveyor loop is advanced and stopped to effect the "y" direction stretching sequence (above mentioned), the two leading edge gripping beams will respectively be at the stitching and loading/unloading positions SP, L/U. With a leading edge gripping beam at the loading/unloading position L/U, the doffer assembly 175 can be activated to pressurize and automatically open the clamps 170, to release the leading edge of the stitched sheet product. The operator can thereafter easily grab and pull the stitched product off of the support bar 167 for transfer then to a nearby bin, take-away conveyor or the like (none shown).

Of further interest, the invention can automatically and accurately adjust the starting positions of the sheet handling mechanism and the sewing machine 158 and its supporting cross bridge 122, operable for handling and stitching sheet (s) of different sizes, not withstanding the specific size of the sheet(s). This might more accurately center or otherwise locate the set patterns of stitching on or relative to the sheet(s) for improved quality, and the automatic sizing might speed up production output for a versatile machine suited for handling interchangeably differently sized sheet(s) for making bedding quilts of all popular sizes, for example. The sizing range of the sheet(s) handling mechanism might provide that the bottom clamping mechanism 180 could be moved vertically (the "Y" dimension) by the drive 184 between its closest spacing (as at 181-min) and it maximum spacing (as at 181-max) from the cross beam 178 and the pre-stretching position PS of the leading edge gripping beam 168*a* or 168*b*; and the side bar 190*a* could be moved horizontally (the "X" dimension) by the ball screw drives 191, 192 between its closest spacing (as at 190*a*-min) from the side bar 190*b* and its maximum spacings (as at SPX). These peripheral sheet(s) holding structures thus might define a smallest window opening and a largest window opening.

With the side bars 190*a*, 190*b* thus shifted to the minimum size window, and optionally also in the converging orientation, a known properly shaped or squared up but otherwise representative sheet(s) would be clamped on the leading edge gripping beam 168*a* or 168*b* and would be advanced to the prestretch position PS, and would be gripped and stretch out substantially flat and tight as above noted. The sewing machine might then be shifted from its initial start or home position located within the boundaries of the minimum window opening, sequentially but both in the "Y" direction by activation of drive 32 and in the "X" direction by activation of drive 42, whereupon suitable detectors (not shown) can be provided and activated to input the respective bridge and platform positions when the respective lower trailing edge and side edge of the sheet(s) held out flat for stitching are detected. These coordinate "Y" and "X" edge positions can be saved in memory for the designated size of the sheet(s), and brought up for similar size sheets. Further, these coordinates can be used to adjust the movement of the sewing machine relative to the sheet(s) as actually sized and held out flat in the handling mechanisms, regardless of the size of the sheet(s), whereby the sewing machine can be accurately directed to stitch the intended pattern accurately centered or otherwise properly positioned relative to the held sheet(s).

Although the disclosure mentions the length and width of the sheet(s), and the height and width of the conveyor loop rear run, the terms may not refer to the same physical dimension or direction. For example, the "width" dimension of the sheet(s) might be extended along the "height" dimension of the rear conveyor run. A machine sized for stitching quilts over all commercially common sizes might have the rear run sized with a maximum clamping capacity or window opening of approximately 10' by 10' and a minimum clamping capacity or window opening of approximately 5' by 5'. With this sizing, the conveyor loop might support two equally spaced leading edge cross beams, to be carried successively and repeatably between the loading/unloading position (at 168*a*) and the stitching position (at 168*c*).

While specific embodiments have been illustrated, it will be obvious that minor changes could be made therefrom without departing from the spirit of the invention. Accordingly, the invention is to determined by the scope of the following claims.

What is claimed is:

1. Apparatus for handling flexible sheet(s) to be stitched by a sewing machine having cooperating needle and hook components, comprising the combination of, clamp means to releasibly grip a leading edge of the sheet(s), and means for moving the clamp means and gripped leading edge to be vertically above the trailing remainder of the sheet(s) suspended between the sewing machine components;

clamp means and means supporting and moving the clamp means to positions suited for gripping opposite side edges of the suspended sheet(s) and then to positions for squaring up the side edges relative to the leading edge;

clamp means to grip a remaining edge of the sheet(s); and means to move the clamp means apart to draw the sheet(s) to a generally flat condition for stitching, whereby the cooperating sewing machine components can be moved as needed to stitch the flexible sheet(s).

2. Apparatus for handling flexible sheet(s) according to claim 1, further comprising said means supporting said side edge clamp means being suited for moving between: an angled converging orientation in the direction toward the trailing edge, and a squared up orientation; and means to detect the side edge during this movement and for gripping the side edge responsive to it being detected.

3. Apparatus for handling flexible sheet(s) according to claim 2, further having said means supporting said side edge clamp means being comprised of an elongated bar extendable in length and separate individual clamps positioned along the length of said bar, suited to accommodate gripping flexible sheet(s) of differing dimensions between the leading and trailing edges.

4. Apparatus for handling flexible sheet(s) according to claim 1, further comprising means supporting and moving the trailing edge clamp means to adjustable positions spaced from the leading edge, suited to accommodate gripping the trailing edge of the suspended sheet(s) of different dimensions between the leading and trailing edges.

5. Apparatus for handling flexible sheet(s) according to claim 4, further having said means supporting said side edge clamp means being comprised of an elongated bar extendable in length and separate individual clamps positioned along the length of said bar, suited to accommodate gripping flexible sheet(s) of differing dimensions between the leading and trailing edges.

6. Apparatus for handling flexible sheet(s) according to claim 5, further having said means supporting and moving the trailing edge clamp means being comprised of an elongated beam extended beyond the side edges of the sheet(s), and said side clamping means support bar being connected at its lower end to the trailing edge clamp means beam.

7. Apparatus for handling flexible sheet(s) according to claim 1, further comprising means for the adjustment of the apparatus for different sizes of suspended sheet(s) by moving the sewing machine from an initial home position within the boundaries of the suspended sheet(s) to positions proximate to edges of the gripped and generally flat drawn sheet(s), and for saving coordinates of these edge positions in memory suited for presizing the machine for similar size sheet(s) for stitching and for centering or otherwise positioning the stitching pattern movement of the sewing machine relative to the sheet(s) as actually sized and held out flat.

8. A method for stitching flexible sheet(s) with a sewing machine having cooperating needle and hook components, comprising the combination of, gripping and pulling on a leading edge of the sheet(s) to move a trailing remainder of the sheet(s) to a suspended orientation therebeneath and between the sewing machine components;

detecting, gripping and pulling on an opposite trailing edge and side edges of the suspended sheet(s) to square up the sheet edges;

moving the gripped side edges apart along an "X" axis and moving the leading and trailing edges apart along a "Y" axis to stretch the sheet(s) flat for stitching; and moving the sewing machine components along the "X" and "Y" axes to stitch the flexible sheet(s).

9. A method for stitching flexible sheet(s) according to claim 8, further wherein the detecting, gripping and pulling steps comprise positioning clamps within the side-to-side area of the suspended sheet(s) and separating such clamps until a respective side edge proximate the trailing edge is detected, closing such clamps for gripping such side edge, and continuing such separating movement of the clamps until the gripped side edge is squared up with the leading edge.

10. A method for stitching flexible sheet(s) according to claim 8, further comprising the steps of moving the sewing machine components from a starting home position within the area of the stretched sheet(s) toward the trailing and side edges, detecting the position of the edges relative to the home position, and coordinating the controls to provide for centering sewing patterns relative to the stretched sheet(s).

* * * * *